US006572455B1

(12) United States Patent
Christian et al.

(10) Patent No.: US 6,572,455 B1
(45) Date of Patent: Jun. 3, 2003

(54) METHOD AND APPARATUS FOR DEBURRING MACHINED WORKPIECES

(75) Inventors: David A. Christian, North Manchester, IN (US); David J. Lucas, Warsaw, IN (US); Charles R. Hileman, Mentone, IN (US); Buddy Kuczewski, Warsaw, IN (US); Charles M. Williams, Etna Green, IN (US)

(73) Assignee: Zimmer, Inc., Warsaw, IN (US)

( * ) Notice: Subject to any disclaimer, the term of this patent is extended or adjusted under 35 U.S.C. 154(b) by 0 days.

(21) Appl. No.: 09/615,217

(22) Filed: Jul. 13, 2000

(51) Int. Cl.[7] ..... B24B 7/00

(52) U.S. Cl. ..... 451/65; 451/66; 451/342; 451/343; 451/461

(58) Field of Search ..... 451/65, 66, 342, 451/343, 461

(56) References Cited

U.S. PATENT DOCUMENTS 4,720,942 A * 1/1988 Miller ..... 51/206
5,020,280 A * 6/1991 O'Reilly ..... 51/168
6,080,053 A * 6/2000 Marvin et al. ..... 451/540
6,238,611 B1 * 5/2001 Hoopman ..... 264/284

* cited by examiner

*Primary Examiner*—Joseph J. Hail, III
*Assistant Examiner*—Alvin J Grant
(74) *Attorney, Agent, or Firm*—Jacque R. Wilson

(57) ABSTRACT

A method and apparatus for deburring nonmetallic machined workpieces. A deburring material of sufficient frictional engagement and hardness to debur nonmetallic workpieces without causing scarring thereto is rubbed against a workpiece to effect deburring. The deburring material has a durometer hardness and a coefficient of friction whereby frictional engagement of a burr with the deburring material is stronger than the attachment of the burr to the workpiece and therefore the burr is removed as the deburring material is actuated and brought into contact with the burr. The deburring material can be, e.g., polyisoprene and may be mechanically actuated or actuated by hand.

6 Claims, 3 Drawing Sheets

METHOD AND APPARATUS FOR DEBURRING MACHINED WORKPIECES

BACKGROUND OF THE INVENTION

1. Field of the invention

The present invention relates to deburring machined workpieces, and, more particularly, to a method and apparatus for deburring nonmetallic machined components of medical devices.

2. Description of the related art

Medical devices such as, e.g., a prosthetic knee or hip include components formed by and/or engraved by machining. Additional medical products formed by machining include, e.g., nonmetallic screws. These products can be formed from a plastic such as polyethylene, or, more specifically, ultra heavy molecular weight polyethylene. Machines, such as, e.g., a mill or a lathe are utilized to efficiently produce these products.

Machining generally produces a workpiece having burrs which must be removed. Machined screws generally have burrs, e.g., in the screw slot. FIG. 2 illustrates screw 20 including burrs 32. Burrs 32 may be formed at various locations in machined workpieces and are shown in slot 26 of screw 20 for illustrative purposes only. Additionally, as mentioned above, information is sometimes engraved on components of medical devices. Engraving can leave minor imperfections and debris which must be removed. For example, the under surface of a polyethylene tibial bearing component often has machined features as well as engraving.

Machined metal parts may be deburred, e.g., with a wire brush, or a grinding stone. Machined metal parts may also be deburred in a vibratory tumbler. The machined metal parts are loaded into the tumbler together with abrasive stones in a liquid (e.g., soap solution) medium. The tumbler is actuated and the parts are deburred through interaction with the abrasive stones. The deburring techniques utilized with metal parts cannot be used with machined plastic parts since these operations would cause significant scarring to a plastic part. A tumbling process cannot be used with plastic parts both because it will scar the parts and because it will impinge foreign materials on the parts.

Prior to use, debris and imperfections such as burrs must be removed from a machined workpiece. Machined nonmetallic workpieces are typically collected at the forming location and transported to an alternative location for cleaning and deburring. With the limitations of the above-mentioned metal deburring techniques in mind, cleaning and deburring of machined nonmetallic workpieces is typically done by hand with a cutting tool such as, e.g., an EXACTO knife or a scalpel together with tweezers. Deburring procedures of this type are time consuming, tedious to perform, and do not produce uniformly shaped workpieces. Additionally, this deburring technique is ineffective in removing fine imperfections in the workpiece such as hair-like burrs (a.k.a. "whiskers") and is hard on the operators who frequently receive nicks and cuts on their hands and fingers.

While mechanical deburring of a nonmetallic workpiece with a stiff bristled brush comprises an available alternative, this procedure suffers significant drawbacks. Application of a stiff bristled brush to a nonmetallic workpiece causes significant scarring of the workpiece and, therefore, cannot effectively be employed.

What is needed in the art is a method and apparatus for deburring a nonmetallic workpiece which yields uniformly shaped parts, decreases the time required for the deburring process, and is not harmful to the operator.

SUMMARY OF THE INVENTION

The foregoing shortcomings of the prior art are addressed by the present invention. The present invention utilizes a deburring material of sufficient frictional engagement and hardness to debur a nonmetallic workpiece without scarring thereof. The deburring material is actuated and applied to a workpiece to effect deburring thereof. When the deburring material is applied to the workpiece, burrs thereon frictionally engage the deburring material. The deburring material has a durometer hardness and a coefficient of friction whereby the frictional engagement of the burr with the deburring material is stronger than the attachment of the burr to the workpiece and therefore the burr is removed as the deburring material is actuated. An acceptable deburring material will have sufficient frictional characteristics to effect deburring as described above, and will have a durometer hardness such that application of the deburring material to the workpiece will not cause scarring of the workpiece. In one exemplary embodiment, the deburring material has a durometer hardness of 40.

In one exemplary embodiment, the present invention utilizes a deburring tool adapted for use with a mechanical actuating device and which includes deburring material affixed thereto. The deburring tool can be positioned as a tool in a CNC lathe which forms the part to be deburred. In this configuration, deburring occurs at the forming station. In one form of the current invention, the deburring material comprises polyisoprene. Polyisoprene is commercially available from, e.g., WARCO (West American Rubber Co., Inc.). One acceptable polyisoprene is 40-R-526 available from WARCO.

The invention, in one form thereof, comprises a deburring tool including an arbor and a disk affixed to the arbor. The disk is formed of a material of sufficient hardness to debur a nonmetallic workpiece without scarring the workpiece.

The invention, in another form thereof, comprises a deburring tool including a support structure with a deburring material affixed thereto. The deburring material is of sufficient frictional engagement and hardness to debur a nonmetallic workpiece without scarring the workpiece.

The invention, in another form thereof, comprises a deburring tool having a deburring surface formed from a material of sufficient frictional engagement and hardness to debur a nonmetallic workpiece without scarring the workpiece and an actuating means for actuating the deburring surface.

The invention, in another form thereof, comprises a method of deburring a machined workpiece. The method of this form of the current invention comprises the steps of: providing a deburring surface formed from a material of sufficient frictional engagement and hardness to debur a nonmetallic workpiece without scarring the workpiece, and rubbing the machined workpiece with the deburring surface.

An advantage of the present invention is the ability to debur a nonmetallic workpiece in a quick and efficient manner.

Another advantage of the present invention is the ability to form substantially uniform nonmetallic workpieces utilizing a machining process.

A further advantage of the present invention is the ability to remove fine imperfections in machined workpieces.

Yet another advantage of the present invention is the ability to debur a workpiece without risking injury to the individual performing this task.

Yet a further advantage is the ability to mechanically debur a nonmetallic workpiece at the forming station and thereby decrease the required floor space to form and debur a product.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates preferred embodiments of the invention and such exemplification is not to be construed as limiting the scope of the invention in any manner.

DETAILED DESCRIPTION OF THE INVENTION

Figure 3:
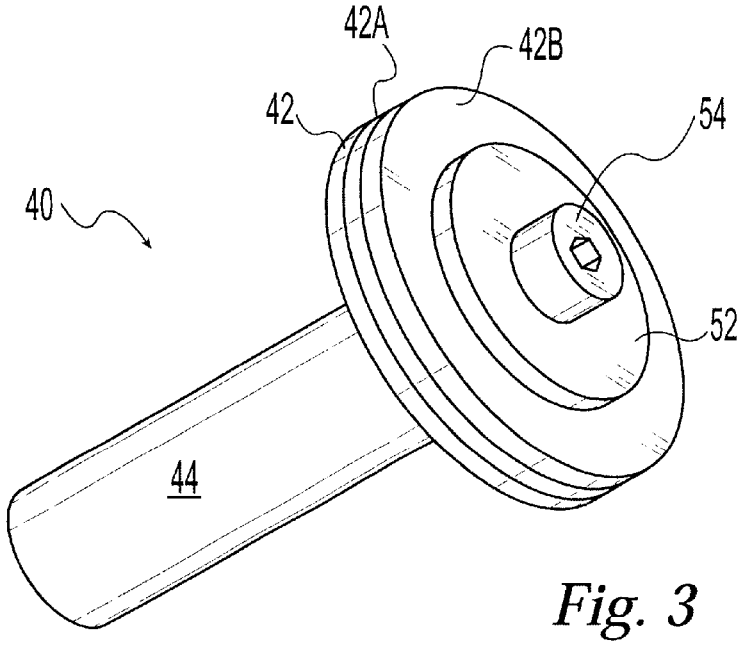
FIG. 3 is a perspective view of a deburring tool in accordance with the present invention.

Referring now to the drawings and particularly to FIG. 3, one exemplary embodiment of deburring tool 40 in accordance with the present invention is illustrated. Deburring tool 40 includes arbor 44 with deburring disks 42, 42A, and 42B affixed thereto. Deburring disks 42, 42A, and 42B are formed from a material having a coefficient of friction when applied to the workpiece, or frictional engagement, and durometer hardness sufficient to debur a nonmetallic workpiece without scarring the workpiece. As described above, the deburring material has a durometer hardness and a coefficient of friction whereby the frictional engagement of a burr with the deburring material is stronger than the attachment of the burr to the workpiece and therefore the burr is removed as the deburring material is actuated and brought into contact with the burr. Thus, the burrs are rubbed from the workpiece by the deburring material. Preferably the deburring material comprises a non-metallic, elastomeric material. Natural or synthetic rubber applied to a solid has a coefficient of friction in the range of 1–4 and therefore comprises an acceptable deburring material. In one exemplary embodiment, 40-R-526 polyisoprene produced by WARCO is utilized as the deburring material, although other material of acceptable frictional engagement and durometer hardness may be utilized within the teachings of the current disclosure.

Figure 4:
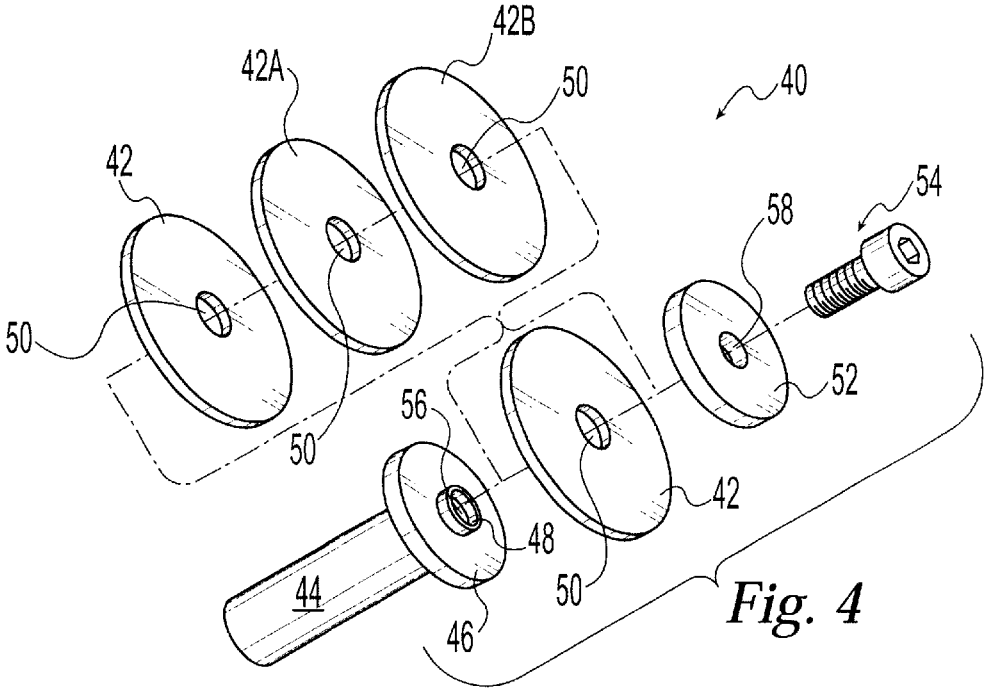
FIG. 4 is an exploded, perspective view thereof.

Referring now to FIG. 4, arbor 44 includes integral distal flange 46 with distal protrusion 48 affixed thereto. Distal flange 46 may be integral with arbor 44, or may be affixed thereto by any of the many well-known affixing techniques known in the art. Internal threaded bore 56 traverses distal protrusion 48, distal flange 46, and subsequently enters arbor 44. Deburring disk 42 includes central aperture 50 sized to accommodate distal protrusion 48 so that deburring disk 42 surrounds distal protrusion 48 when operably positioned on arbor 44.

To assemble deburring tool 40, distal protrusion 48 is placed through central aperture 50 of deburring disk 42 and washer 52 is coaxially positioned on deburring disk 42. Bolt 54 is placed through central aperture 58 of washer 52 and into internal threaded bore 56. Bolt 54 is tightened so that deburring disk 42 is affixed to arbor 44 with distal flange 46 and washer 52 abutting deburring disk 42 on opposing sides thereof.

As illustrated in FIG. 4, multiple disks may be utilized to construct deburring tool 40. While FIG. 4 illustrates embodiments having one or three deburring disks 42, any number of disks may be utilized in accordance with the teachings of the present invention. Modifications to the illustrated embodiment may be made to accommodate a greater number of deburring disks. Such modifications may include, e.g., axial extension of distal protrusion 48, and bolt 54 to accommodate the width of a plurality of deburring disks 42. Distal protrusion 48 may extend through the entirety of the cumulative thickness of a plurality of deburring disks 42 affixed to arbor 44, or may extend through only a portion thereof. If a relatively large component of a medical device includes engraving which must be cleaned and deburred, an embodiment including a relatively large number of deburring disks having a cumulative width equal to the length of the engraved material may advantageously be utilized to quickly clean and debur the engraving.

Figure 5:
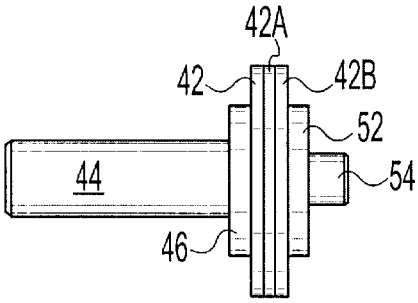
FIG. 5 is a radial elevational view thereof.

FIG. 5 illustrates deburring tool 40 in assembled form. As illustrated, thickness T of deburring disks 42 is 0.155 centimeters (0.061 inches). Thickness T of deburring disk 42 of this exemplary embodiment is not limiting of the current invention in any way. Those of ordinary skill in the art will readily recognize that deburring disks 42 of various thickness and number will be utilized according to the geometry of the workpiece to be deburred. Furthermore, a plurality of disks having non-uniform thickness may be utilized on a single deburring tool 40.

Figure 1:
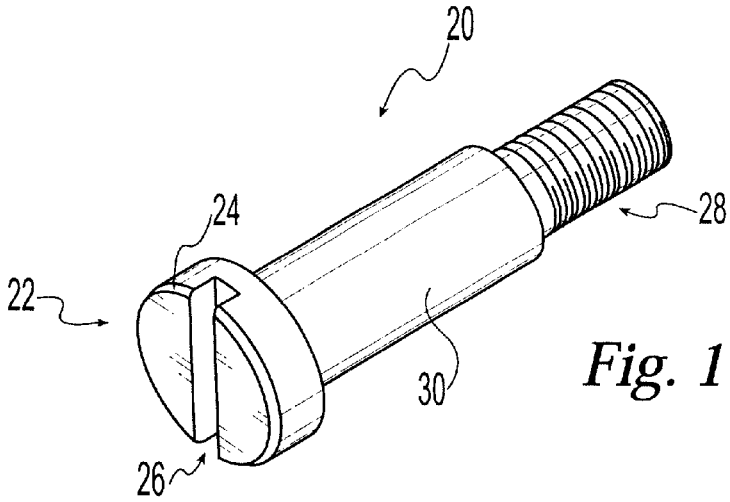
FIG. 1 is a perspective view of a machined workpiece formed in accordance with the present invention.
Figure 2:
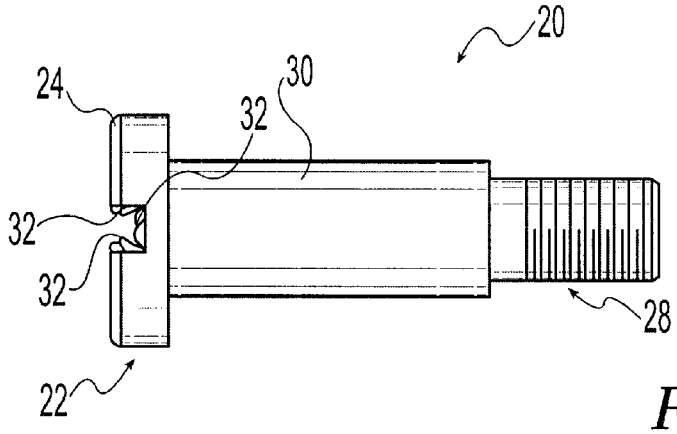
FIG. 2 is a radial elevational view thereof prior to deburring.
Figure 6A:
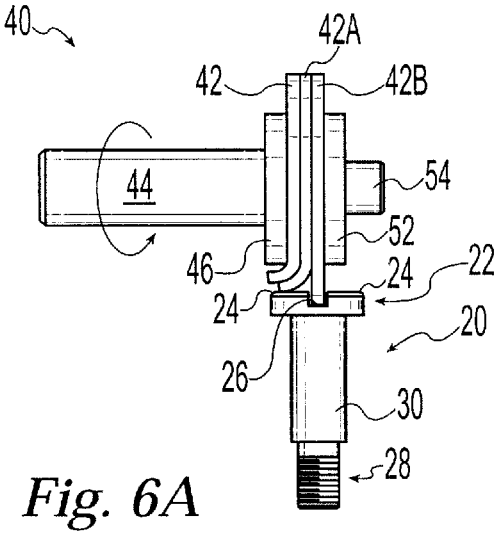
FIGS. 6A and 6B are radial elevational views illustrating application of a deburring tool of one embodiment of the present invention to a workpiece.
Figure 6B:
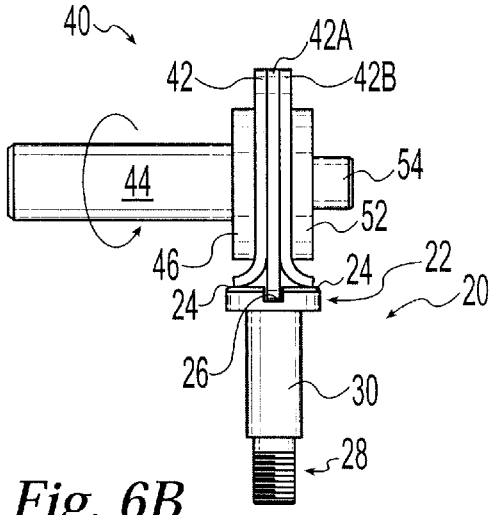
Figure 11:
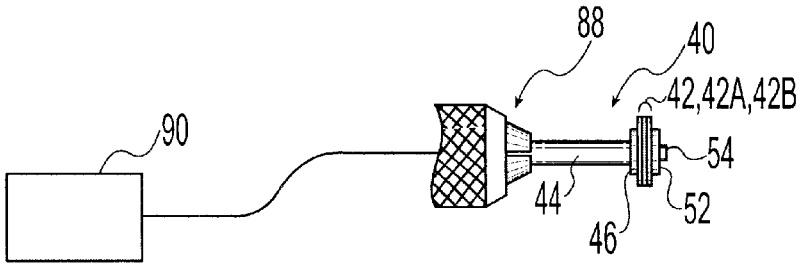
FIG. 11 is a diagrammatic illustration of a debarring tool of the present invention and an actuating mechanism therefor.

FIGS. 6A, and 6B illustrate application of deburring tool 40 to screw 20. As illustrated in FIG. 1, screw 20 generally comprises threads 28, shaft 30, and head 22. As illustrated in FIGS. 6A, and 6B, deburring tool 40 is oriented so that the longitudinal axis of arbor 44 is perpendicular to the longitudinal axis of screw 20. In this form of the current invention, arbor 44 is mechanically rotated to actuate deburring disks 42, 42A, and 42B. Machine 90 (FIG. 11) may be utilized to actuate chuck 88 and consequently arbor 44 and deburring disks 42, 42A, and 42B.

FIGS. 6A, and 6B illustrate deburring of screw 20 wherein relative movement between deburring tool 40 and screw 20 causes third deburring disk 42B to initially occupy slot 26 of screw 20 (FIG. 6A). Relative movement subsequently causes second deburring disk 42A to occupy slot 26 of screw 20. Relative movement in this manner allows screw head 22 including bevel 24 and slot 26 to be cleaned and deburred by deburring tool 40. The deburring operation illustrated in FIGS. 6A and 6B is illustrative only. It will be understood by those skilled in the art that different cleaning surface geometries and cleaning surface to workpiece angles will be utilized depending upon the geometry of the workpiece to be deburred.

Figure 7:
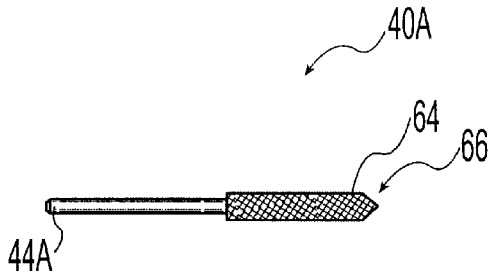
FIG. 7 is a radial elevational view of a deburring tool in accordance with an alternative embodiment of the current invention.

FIGS. 7, 8, 9, and 10 illustrate alternative embodiments of the present invention. Referring now to FIG. 7, deburring tool 40A includes arbor 44A with deburring material 64 affixed thereto. In this embodiment, deburring material 64 includes tapered distal end 66. Deburring material 64 can have, e.g., a circular, oval, elliptical, or polygonal cross section. Similarly, tapered distal end 66 may taper off substantially to a point, or may taper off to a line. For example, if deburring material 64 has a square cross section, tapered distal end 66 may have a square (ending substantially in a point) cross section or a rectangular (ending substantially in a line) cross section.

Figure 8:
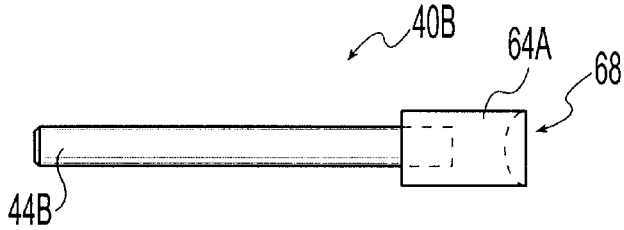
FIG. 8 is a radial elevational view of a deburring tool in accordance with another alternative embodiment of the current invention.

Referring now to FIG. 8, deburring tool 40B includes arbor 44B with deburring material 64A affixed thereto. In this embodiment, deburring material 64A ends in concave distal end 68. As described above, deburring material 64A may be formed with one of many different cross sections, including, e.g., circular, oval, elliptical, or polygonal.

Figure 9:
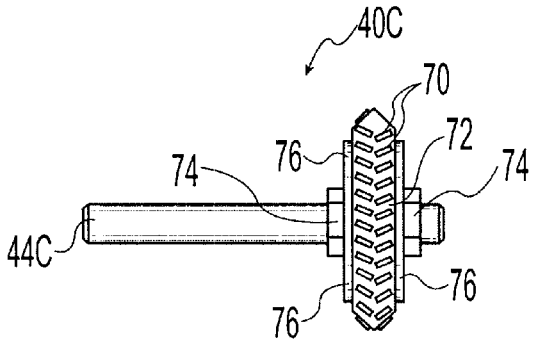
FIG. 9 is a radial elevational view of a deburring tool in accordance with a further alternative embodiment of the current invention.

FIG. 9 illustrates yet another alternative embodiment of deburring tool 40C. In this embodiment, cylinder 72 is affixed to arbor 44C. Nuts 74 and washers 76 operate to affix cylinder 72 to arbor 44, although other affixing means as are known in the art may be utilized. Cylinder 72 has a tapered outer diameter with protrusions 70 protruding therefrom. Protrusions 70 are formed of deburring material and, in one exemplary embodiment, extend from cylinder 72 in a skewed configuration.

Figure 10:
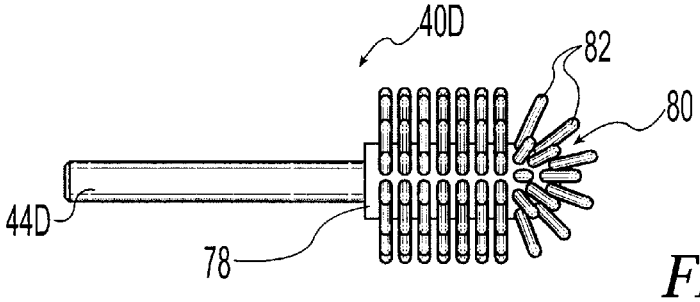
FIG. 10 is a radial elevational view of a deburring tool in accordance with yet another alternative embodiment of the current invention.

FIG. 10 illustrates yet another alternative embodiment of deburring tool 40D. In this embodiment, arbor 44D is affixed to cylindrical portion 78. Cylindrical portion 78 includes convex distal end 80. Cylindrical portion 78 may be integral with arbor 44 or may be affixed thereto using any conventional means as are known in the art. Deburring tool 40D of this form of the current invention includes generally radial protrusions 82, formed of deburring material, emanating from cylindrical portion 78 and convex distal end 80.

Any of the alternative embodiments of deburring tool 40 may be affixed to chuck 88, actuated by machine 90, and applied to a workpiece for deburring thereof. The alternative embodiments illustrated in FIGS. 7-10 are included for illustrative purposes only.

Generally, the method of the current invention contemplates the provision of a deburring surface formed from a material of sufficient frictional engagement and hardness to debur a nonmetallic workpiece without scarring the workpiece, actuating the material, and applying the material to a workpiece. The deburring material may be mechanically actuated or actuated by hand. The deburring material may, e.g., comprise polyisoprene. In use, the deburring material may be periodically cleaned with, e.g., isopropyl alcohol to maintain the tack thereof.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known of customary practice in the art to which this invention pertains and which fall within the limits of the appended claims.

What is claimed is:

1. A deburring tool, comprising: an arbor; and a first disk affixed to said arbor, said first disk being formed of a material of sufficient frictional engagement and hardness to debur a non-metallic work piece without scarring said work piece, wherein said deburring tool includes a distal flange supporting said first disk, and wherein the deburring tool further comprises a distal protrusion affixed to said distal flange, wherein said first disk includes a central aperture sized to accommodate said protrusion.

2. A deburring tool comprising: a support structure; and a deburring material affixed to said support structure, said deburring material being of sufficient frictional engagement and hardness to debur a non-metallic work piece without scarring said work piece, wherein said deburring material forms a plurality of protrusions on a cylinder having a tapered outer diameter, and wherein said cylinder is affixed to said support structure.

3. The tool of claim 2, wherein said protrusions have a rectangular cross section.

4. The tool of claim 3, wherein said protrusions radially extend from said cylinder in a skewed configuration.

5. The tool of claim 2, wherein said support structure includes a cylindrical portion having a convex distal end, and wherein said deburring material is formed into a plurality of generally radial protrusions emanating from said cylindrical portion and said convex distal end.

6. The tool of claim 5, wherein each of said generally radial protrusions has a circular cross section.

* * * * *